US009663993B2

(12) United States Patent
Gajji et al.

(10) Patent No.: US 9,663,993 B2
(45) Date of Patent: May 30, 2017

(54) DIRECTIONAL DRILLING SYSTEM AND METHODS

(71) Applicant: Halliburton Energy Services, Inc., Houston, TX (US)

(72) Inventors: Bhargav Gajji, Pune (IN); Puneet Agarwal, Pune (IN); Rahul Ramchandra Gaikwad, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/404,140

(22) PCT Filed: Dec. 30, 2013

(86) PCT No.: PCT/US2013/078353
§ 371 (c)(1),
(2) Date: Nov. 26, 2014

(87) PCT Pub. No.: WO2015/102584
PCT Pub. Date: Jul. 9, 2015

(65) Prior Publication Data

US 2016/0298392 A1 Oct. 13, 2016

(51) Int. Cl.

| | |
|---|---|
| ***E21B 7/06*** | (2006.01) |
| ***E21B 3/00*** | (2006.01) |
| ***E21B 4/00*** | (2006.01) |
| *E21B 47/024* | (2006.01) |
| *E21B 47/18* | (2012.01) |
| *E21B 49/00* | (2006.01) |

(52) U.S. Cl.
CPC ..... *E21B 7/067* (2013.01); *E21B 3/00* (2013.01); *E21B 4/00* (2013.01); *E21B 47/024* (2013.01); *E21B 47/18* (2013.01); *E21B 49/00* (2013.01)

(58) Field of Classification Search
CPC . E21B 7/068; E21B 7/067; E21B 7/04; E21B 7/046
USPC ..... 175/61
See application file for complete search history.

(56) References Cited

U.S. PATENT DOCUMENTS 5,220,963 A * 6/1993 Patton ..... E21B 7/04 175/24
5,602,541 A 2/1997 Comeau et al.
(Continued)

FOREIGN PATENT DOCUMENTS

WO WO-2015/102584 A1 7/2015

OTHER PUBLICATIONS

"International Application Serial No. PCT/US2013/078353, International Search Report mailed Sep. 25, 2014", 4 pgs.
(Continued)

*Primary Examiner* — Taras P Bemko
(74) *Attorney, Agent, or Firm* — Chamberlain Hrdlicka

(57) ABSTRACT

A directional drilling steering system is configured to direct a tubular sleeve arranged at the bottom of a drill string adjacent the drill bit at a selected tilt angle with respect to the longitudinal axis of the uphole drill string and at a selected azimuth. Tilt angle can be achieved by axial movement of one or more pistons in engagement with the downhole tubular sleeve. Azimuth can be achieved by axial movement of the pistons or by rotation of the drill string. The movement of the downhole sleeve along the deviated path causes movement of the drill bit shaft and the drill bit coupled thereto.

32 Claims, 8 Drawing Sheets

(56) References Cited

U.S. PATENT DOCUMENTS

| | | | | |
|---|---|---|---|---|
| 6,092,610 | A | 7/2000 | Kosmala et al. | |
| 6,158,529 | A | 12/2000 | Dorel | |
| 6,607,044 | B1 | 8/2003 | Eppink et al. | |
| 7,861,802 | B2 | 1/2011 | Underwood et al. | |
| 8,322,461 | B2 | 12/2012 | Hay et al. | |
| 2003/0010534 | A1 | 1/2003 | Chen et al. | |
| 2004/0104051 | A1 | 6/2004 | Moriarty et al. | |
| 2009/0183921 | A1* | 7/2009 | Gurjar | E21B 7/067 175/61 |
| 2012/0018225 | A1* | 1/2012 | Peter | E21B 7/067 175/61 |

OTHER PUBLICATIONS

"International Application Serial No. PCT/US2013/078353, Written Opinion mailed Sep. 25, 2014", 4 pgs.

* cited by examiner

DIRECTIONAL DRILLING SYSTEM AND METHODS

PRIORITY APPLICATION

This application is a U.S. National Stage Filing under 35 U.S.C. 371 from International Application No. PCT/US2013/078353, filed on 30 Dec. 2013; which application is incorporated herein by reference in its entirety.

BACKGROUND

This disclosure relates to directional drilling of subterranean wells. Directional or steerable drilling rigs are employed to drill wellbores that deviate by some degree from a vertical path into a subterranean formation. Various types of directional drilling systems have been employed to drill deviated wellbores, including, for example, so-called "point-the-bit" and "push-the-bit" systems. In point-the-bit systems, the bottom hole assembly (BHA) steers the drill bit in a particular direction relative to an axis of the BHA by deflecting a shaft, to deviate from the current borehole path. In push-the-bit systems, a mechanism such as a pad pushes against the formation to cause the drill bit to deviate from the current borehole path.

DETAILED DESCRIPTION

Figure 1:
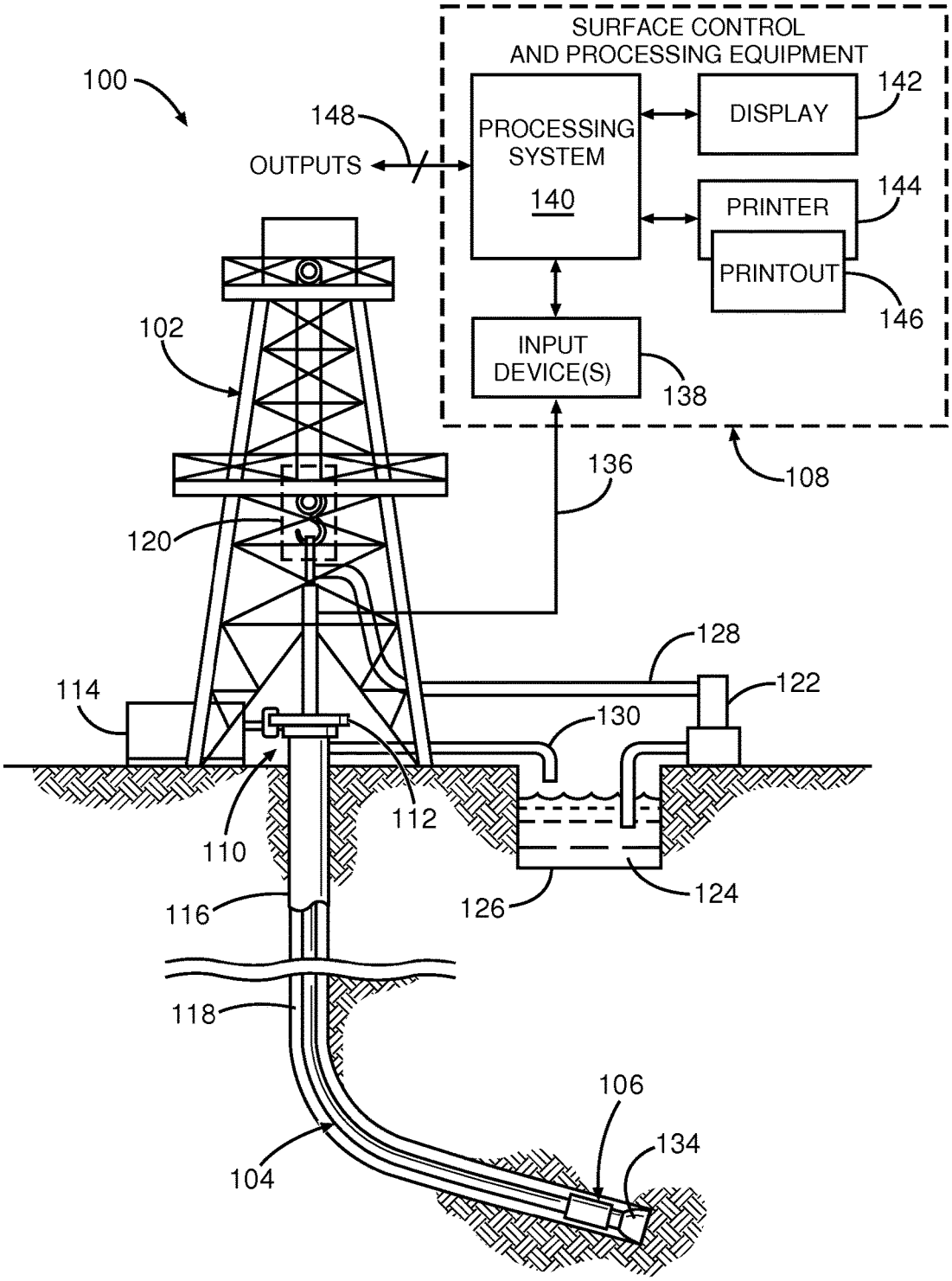
FIG. 1 schematically depicts an example directional drilling system in accordance with this disclosure.

Examples according to this disclosure are directed to systems and methods for directional drilling of subterranean wellbores. In one example, a directional drilling steering system is configured to direct a tubular sleeve arranged at the bottom of a drill string adjacent the drill bit at a selected tilt angle with respect to the longitudinal axis of the uphole drill string and at a selected azimuth. Tilt angle can be achieved by axial movement of one or more pistons in engagement with the downhole tubular sleeve. Azimuth can be achieved by axial movement of the pistons or by rotation of the drill string. The movement of the downhole sleeve along the deviated path causes movement of the drill bit shaft and the drill bit coupled thereto.

In some examples according to this disclosure, an actuation system is configured to direct the downhole tubular sleeve at a selected tilt angle and azimuth. The drill bit shaft is can be connected to the downhole sleeve and to the uphole portion of the drill string such that, when the sleeve is turned away from the vertical path of the uphole string, the bit shaft bends to direct the drill bit at the selected tilt angle and azimuth. In one example, the downhole sleeve is directed by axially moving pistons, which are actuated by a rotary actuation mechanism.

Examples according to this disclosure can provide a number of advantages. Bending in the bit shaft can be made smooth and continuous, as the bending is guided by the downhole sleeve, instead of inflection points as in other tools. Also, in some examples according to this disclosure the axial piston actuation of the downhole sleeve can be more easily accommodated for smaller diameter tool strings, because the actuator mechanism is rotary and the actuation direction is axial, and therefore produces a more compact steering arrangement compared to other tools.

One example drill apparatus according to this disclosure includes a first tubular sleeve, a second tubular sleeve, a drill bit shaft, at least one piston, and an actuator. The bit shaft includes a first end arranged in the first sleeve and a second end arranged in the second sleeve. The piston(s) extend from the first sleeve and engage the second sleeve. The piston(s) are axially moveable relative to the first sleeve and arranged radially outward of the bit shaft. The actuator is configured to selectively axially move the piston(s) to direct the second sleeve and the second end of the bit shaft at a selected tilt angle with respect to a longitudinal axis of the first sleeve. In some examples, the drill apparatus can include a plurality of pistons arranged circularly about the bit shaft and the actuator can be configured to selectively axially move less than all of the pistons to direct the second sleeve and the second end of the bit shaft at the selected tilt angle with respect to the longitudinal axis of the first sleeve and at a selected azimuth. In some examples, the first sleeve (and possibly other portions of a drill string connected thereto) is configured to be rotated about the longitudinal axis to dispose the bit shaft at a selected azimuth.

FIG. 1 schematically depicts a directional drilling system 100 that is configured to form wellbores at a variety of possible trajectories, including those that deviate from a vertical. Directional drilling system 100 may include a land drilling rig 102 to which is attached a drill string 104 and a bottom hole assembly 106 (hereinafter BHA) in accordance with this disclosure. The present disclosure is not limited to land drilling rigs. Examples according to this disclosure may also be employed in drilling systems associated with offshore platforms, semi-submersible, drill ships and any other drilling system satisfactory for forming a wellbore extending through one or more downhole formations.

Drilling rig 102 and associated surface control and processing system 108 can be located proximate well head 110. Drilling rig 102 can also include rotary table 112, rotary drive motor 114 and other equipment associated with rotation of drill string 104 within wellbore 116. Annulus 118 may be formed between the exterior of drill string 104 and the inside diameter of wellbore 116.

For some applications drilling rig 102 can also include a top drive unit 120. Blow out preventers (not expressly shown) and other equipment associated with drilling wellbore 116 may also be provided at well head 110. One or more pumps 122 may be used to pump drilling fluid 124 from fluid reservoir 126 to one end of drill string 104 extending from well head 110. Conduit 128 can be used to supply drilling mud from pump 122 to the one end of drilling string 104 extending from well head 110. Conduit 130 can be used to return drilling fluid, formation cuttings and/or downhole debris from the bottom or end of wellbore 116 to fluid reservoir 126. Various types of pipes, tubing and/or other conduits may be used to form conduits 128 and 130.

Drill string 104 may extend from well head 110 and may be coupled with the supply of drilling fluid 128 from reservoir 126. Opposite end of drill string 104 may include BHA 106 including rotary drill bit 134 disposed adjacent to end of well bore 116. Rotary drill bit 134 can include one or more fluid flow passageways with respective nozzles disposed therein. Various types of drilling fluids may be pumped from reservoir 126 through pump 122 and conduit 128 to the end of drill string 104 extending from well head 110. The drilling fluid may flow through a longitudinal bore (not expressly shown) of drill string 104 and exit from nozzles formed in rotary drill bit 134.

At the end of wellbore 116 drilling fluid may mix with formation cuttings and other downhole debris proximate drill bit 134. The drilling fluid will then flow upwardly through annulus 118 to return formation cuttings and other downhole debris to well head 110. Conduit 130 can return the drilling fluid to reservoir 126. Various types of screens, filters and/or centrifuges (not expressly shown) may be provided to remove formation cuttings and other downhole debris prior to returning drilling fluid to reservoir 126.

Bottom hole assembly (BHA) 106 can include various components associated with a measurement while drilling (MWD) system or logging while drilling (LWD) that provides logging data and other information from the bottom of wellbore 116 to surface equipment 108. Logging data and other information may be communicated from BHA 106 through drill string 104 using MWD/LWD techniques, including, for example, mud pulse telemetry, and converted to electrical signals at well head 110 and/or surface equipment 108. Electrical conduit or wires 136 can communicate the electrical signals to input device(s) 138. The logging data provided from input device 138 can then be directed to a data processing system 140. Data processing system 140 can include a variety of hardware, software, and combinations thereof, including, for example, one or more programmable processors configured to execute instructions on and retrieve data from and store data on a memory to carry out one or more functions attributed to data processing system 140 in this disclosure. The processors employed to execute the functions of data processing system 140 may each include one or more processors, such as one or more microprocessors, digital signal processors (DSPs), application specific integrated circuits (ASICs), field programmable gate arrays (FPGAs), programmable logic circuitry, and the like, either alone or in any suitable combination. Various displays 142 may be provided as part of surface equipment 108.

For some applications, a printer 144 and associated printouts 146 can also be used to monitor the performance of drilling string 104, BHA 106 and associated rotary drill bit 134. For many applications, outputs 148 may be communicated to various components associated with operating drilling rig 102 and may also be communicated to various remote locations to monitor the performance of directional drilling system 100.

Figure 2:
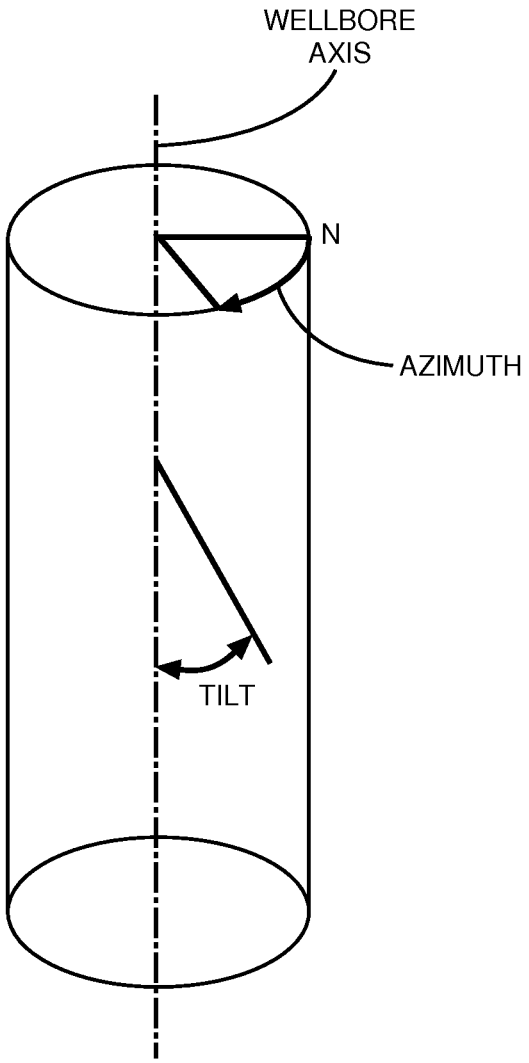
FIG. 2 schematically depicts a number of parameters used to control the path of a directional drilling system.

BHA 106 includes a system in accordance with this disclosure, which is configured to direct drill bit 134 at a selected tilt angle and at a selected azimuth to form a deviated wellbore, such as the deviated wellbore 116 illustrated in FIG. 1. FIG. 2 schematically depicts the two parameters that can be employed to define a deviated wellbore path in directional drilling systems in accordance with this disclosure. As illustrated in FIG. 2, the tilt angle represents an angle, usually acute, which deviates from the longitudinal axis of the vertical section of the wellbore by a particular degree. Azimuth represents an angular measurement around the circumference of the wellbore from a particular reference point on the circumference. The reference point on the circumference of the wellbore can be defined based on a particular cardinal direction, like North, as illustrated in FIG. 2. More formally, azimuth is an angular measurement in a spherical coordinate system. The vector from an observer (origin) to a point of interest is projected perpendicularly onto a reference plane; the angle between the projected vector and a reference vector on the reference plane is called the azimuth.

Generally, in order to form a deviated wellbore, drilling system 100 includes a system to set and control the direction of drilling of drill bit 134 and a mechanism to dispose drill bit 134 at the correct orientation to achieve the deviated path defined by the direction of drilling. The MWD system included in BHA 106 or another such downhole system and/or surface equipment 108 can be employed to set and control the direction of drill bit 134 to form deviated wellbore 116. In one example, BHA 106 includes sensors including, for example, a gamma ray and inclinometer instrument package adjacent drill bit 134 and a multiple depth dual frequency borehole compensated resistivity tool. In one example, BHA 106 includes a combination of one or more of magnetometers, accelerometers, and gyroscopes to set and control the direction of drill bit 134 to form deviated wellbore 116. These components of BHA 106 can be configured to produce data indicating the tilt angle and azimuth of drill bit 134 and the position of BHA 106 with respect to the formation. The data generated by sensors and other components of BHA 106 can be processed by processor(s) incorporated into the BHA 106 and/or can be communicated to surface equipment 108 for processing, for example, by data processing system 140. Regardless of the location of the processing system, data related to the trajectory of BHA 106 and drill bit 134 can be processed to set the drilling orientation and generate control signals configured to cause a steering mechanism of BHA 106 to dispose drill bit 134 at a particular tilt angle and azimuth.

In one example, BHA 106 includes a steering mechanism including an actuation system that is configured to direct a tubular sleeve that is arranged at the bottom of drill string 104 adjacent drill bit 134. The steering mechanism directs the sleeve at a selected tilt angle with respect to the longitudinal axis of the uphole drill string and at a selected azimuth. The drill bit shaft is connected to the downhole sleeve and to an uphole portion of drill string 104 such that, when the sleeve is turned away from the vertical path of the uphole portion of string 134, the bit shaft connected to drill bit 134 bends to direct bit 134 at the selected tilt angle and azimuth. In one example, the downhole sleeve is directed by axially moving pistons, which are actuated by a rotary actuation mechanism. Example steering mechanisms in accordance with this disclosure including one that can be employed with BHA 106 are described in more detail below with reference to FIGS. 3A-4B.

In some examples, BHA 106 can also include other sensors and components for providing other information. For example, BHA 106 can include sensors and other components for providing gyroscopic survey data, resistivity measurements, downhole temperatures, downhole pressures, flow rates, velocity of the power section, gamma ray measurements, fluid identification, formation samples, and pressure, shock, vibration, weight on bit, torque at bit, and other sensor data.

As noted above, drill string 104 can be configured to be rotationally driven by motor 114 and top drive unit 120. Rotation of drill string 104 can be employed to drive drill bit 134 to drill wellbore 116. Additionally, in some examples, drilling system 100 can include a downhole motor, for example, included in BHA 106. In one example, BHA 106 can include a positive displacement motor, including, for example, a fluid-driven motor like a mud motor. The power of a positive displacement motor is generated by a power generation section that includes a rotor and stator which have helical lobes that mesh to form sealed helical cavities. When drilling fluid is pumped through the positive displacement motor, the fluid advancing through the cavities forces the rotor to rotate. The downhole motor in such examples can also be employed to drive drill bit 134 to drill wellbore 116. Steering mechanisms in accordance with this disclosure can be employed with drilling systems that rotate the entire drill string to drive the downhole drill bit and/or systems including a downhole motor that drives the drill bit.

FIGS. 3A-3E depicts an example drill apparatus in accordance with this disclosure, which in the following examples is referred to as steering mechanism 300. Steering mechanism 300 can be included in a BHA of a land-based or submersible directional drilling system. In FIG. 3, steering mechanism 300 includes first and second tubular sleeves 302 and 304, respectively, a drill bit shaft 306, and pistons 308. Steering mechanism 300 also includes rotary actuator 314, cylinder housing 316, thrust pad 318, and radial bearings 320. Thrust pad 318 and radial bearings 320 are arranged within second sleeve 304. Thrust pad 318 is arranged at the uphole end of second sleeve 304. Radial bearings 320 are successively arranged at different positions downhole from the uphole end of second sleeve 304.

Figure 3A:
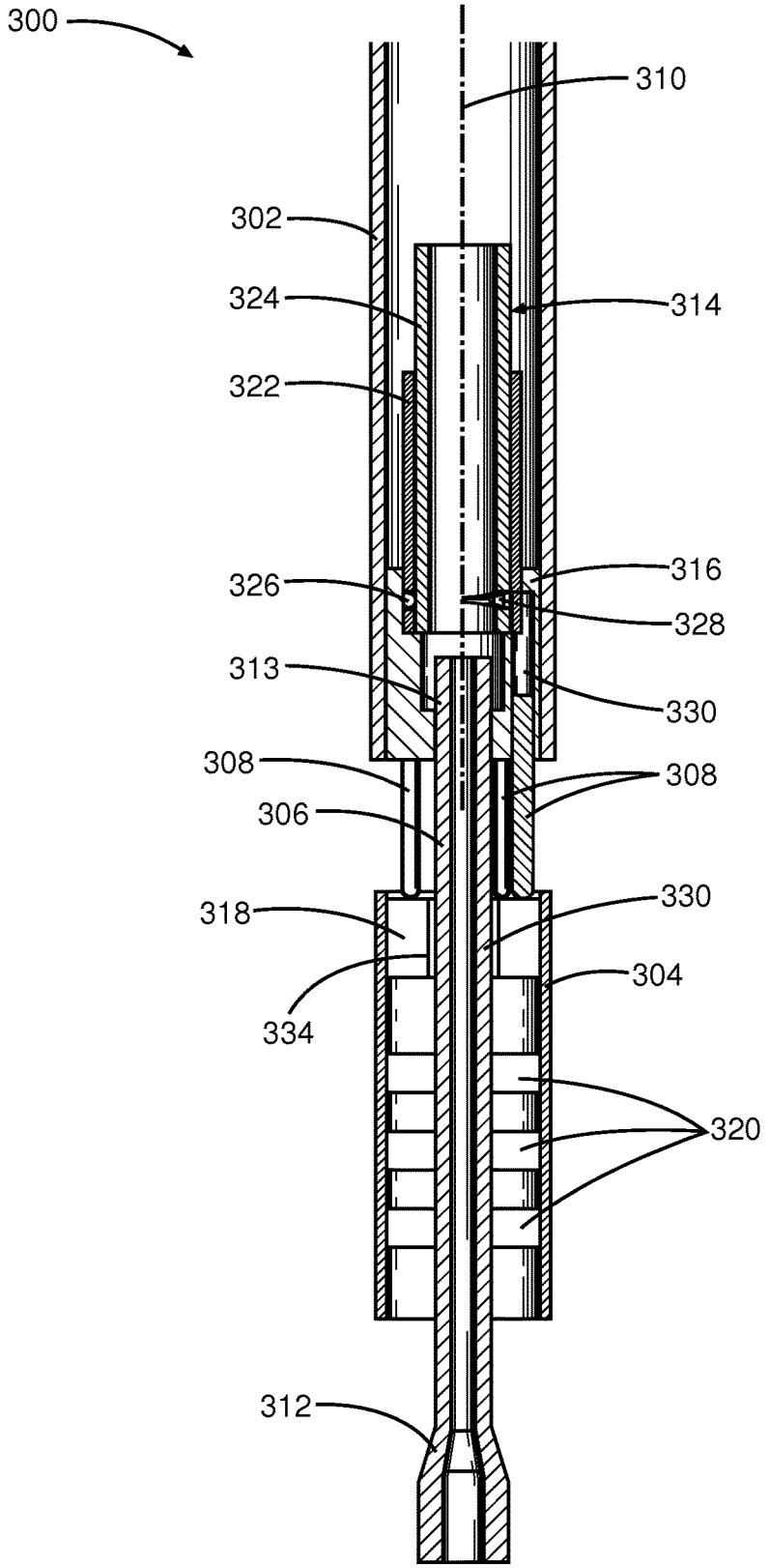
FIGS. 3A-3E depict an example steering mechanism in accordance with this disclosure.
Figure 3C:
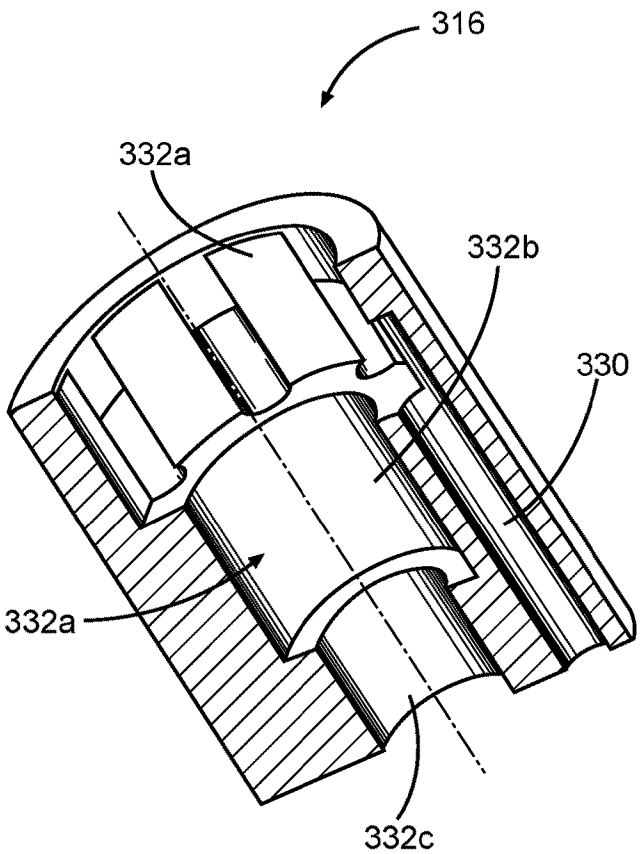
Figure 3B:
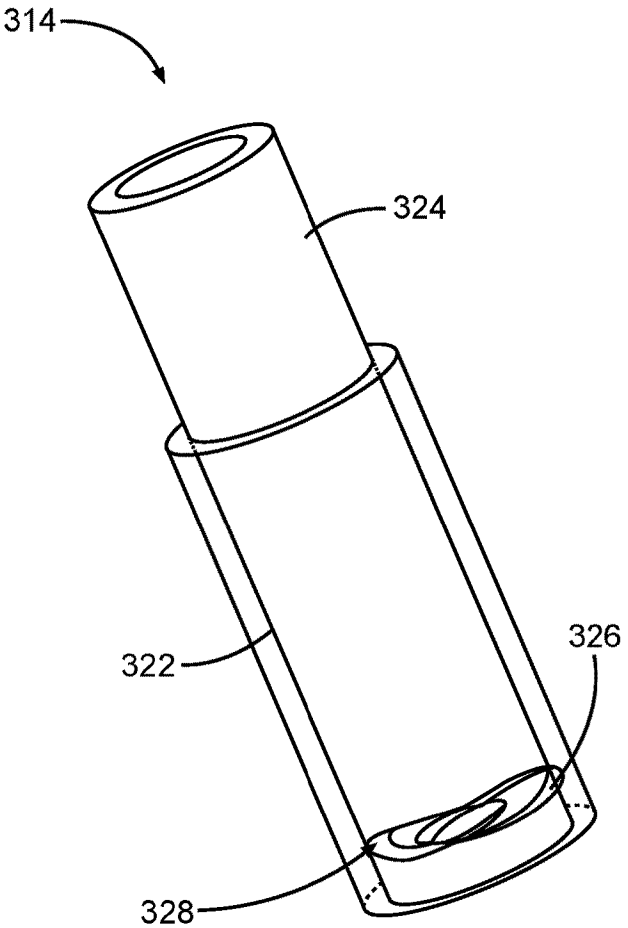

Components of rotary actuator 314 are depicted in more detail in FIG. 3B and cylinder housing 316 is depicted in more detail in FIG. 3C. Rotary actuator 314 includes third and fourth tubular sleeves 322 and 324, respectively. Fourth sleeve 324 is partially received within third sleeve 322. Third sleeve 322 includes circumferential aperture 326 through a portion of the circumference of sleeve 322. Fourth sleeve 324 includes circumferential aperture 328 through a portion of the circumference of sleeve 324. As illustrated in FIG. 3B, circumferential apertures 326 and 328 are circular or oval shaped apertures in the respective circumferences of third and fourth sleeves 322 and 324.

Cylinder housing 316 includes a number of cylinders 330, in which pistons 308 are arranged. As illustrated in FIG. 3C, cylinder housing 316 also includes a central bore 332 including a number of differently sized sections, including first section 332*a*, second section 332*b*, and third section 332*c*. The diameter of first section 332*a* is sized to receive third sleeve 322 of rotary actuator 314. The diameter of third section 332*c* is sized to receive and match a portion of bit shaft 306.

Pistons 308 are circularly arranged about longitudinal axis 320 of first sleeve 302. The number of pistons 308 can be varied depending on the amount of azimuth precision is desired or required for a particular application. In general, the greater the number of pistons included in steering mechanisms in accordance with this disclosure the greater the amount of precision with respect the drill bit azimuth can be set. Each piston 308 is arranged and configured to move axially within one of cylinders 330 in cylinder housing 316. Pistons 308 extend from the downhole end of first sleeve 302 toward and into engagement with thrust pad 318 at the uphole end of second sleeve 304.

In operation, a number of the chambers of steering mechanism 300 can be filled with a pressurized fluid which, in conjunction with the rotational positioning of third and fourth sleeves 322 and 324, respectively, of rotary actuator 314, functions to vary the axial position of pistons 308. In one example, drilling fluid or "mud" is allowed to penetrate the chambers of steering mechanism 300 and is thereby employed to actuate pistons 308 to direct downhole end 312 of bit shaft 306 at a particular tilt angle and azimuth for directional drilling of a wellbore.

Rotary actuator 314 is configured to be controlled to vary the pressure within cylinders 330, which, in turn, varies the axial position of pistons 308 with respect to second sleeve 304. For example, each of third and fourth sleeves 322 and 324, respectively, can be individually rotated into various positions with respect to each other and with respect to cylinder housing 316. Third and fourth sleeves 322 and 324 can be rotated to align circumferential apertures 326 and 328 with one another and with one or more of cylinders 330 such that the pressurized drilling fluid within portions of steering mechanism will act on one or more of pistons 308. By varying the amount of alignment between circumferential apertures 326 and 328 and one or more of cylinders 330, rotary actuator 314 can be configured to precisely axially position one or more of pistons 308. In some examples, a variety of filtering mechanisms can be employed on circumferential apertures 326 and 328 to filter out debris from, for example, the drilling mud before the fluid enters cylinders 330.

In order to achieve the azimuthal control, third sleeve 322 can be rotated relative to first sleeve 302 and cylinder housing 316 to bring circumferential aperture 326 into alignment with one or more particular cylinders 330 and pistons 308. The tilt angle can be set based on the alignment between circumferential apertures 326 and 328. For example, fourth sleeve 324 can be rotated relative to third sleeve 322 to bring circumferential apertures 326 and 328 into alignment with one another. Aligning circumferential apertures 326 and 328 will function to allow the working fluid, for example, mud to flow into selected cylinders 330, which, in turn, functions to axially move selected pistons 308. The amount of alignment between circumferential apertures 326 and 328 can be used to control the pressure within cylinders 330 and thereby to control the amount of axial movement of pistons 308.

Figure 3D:
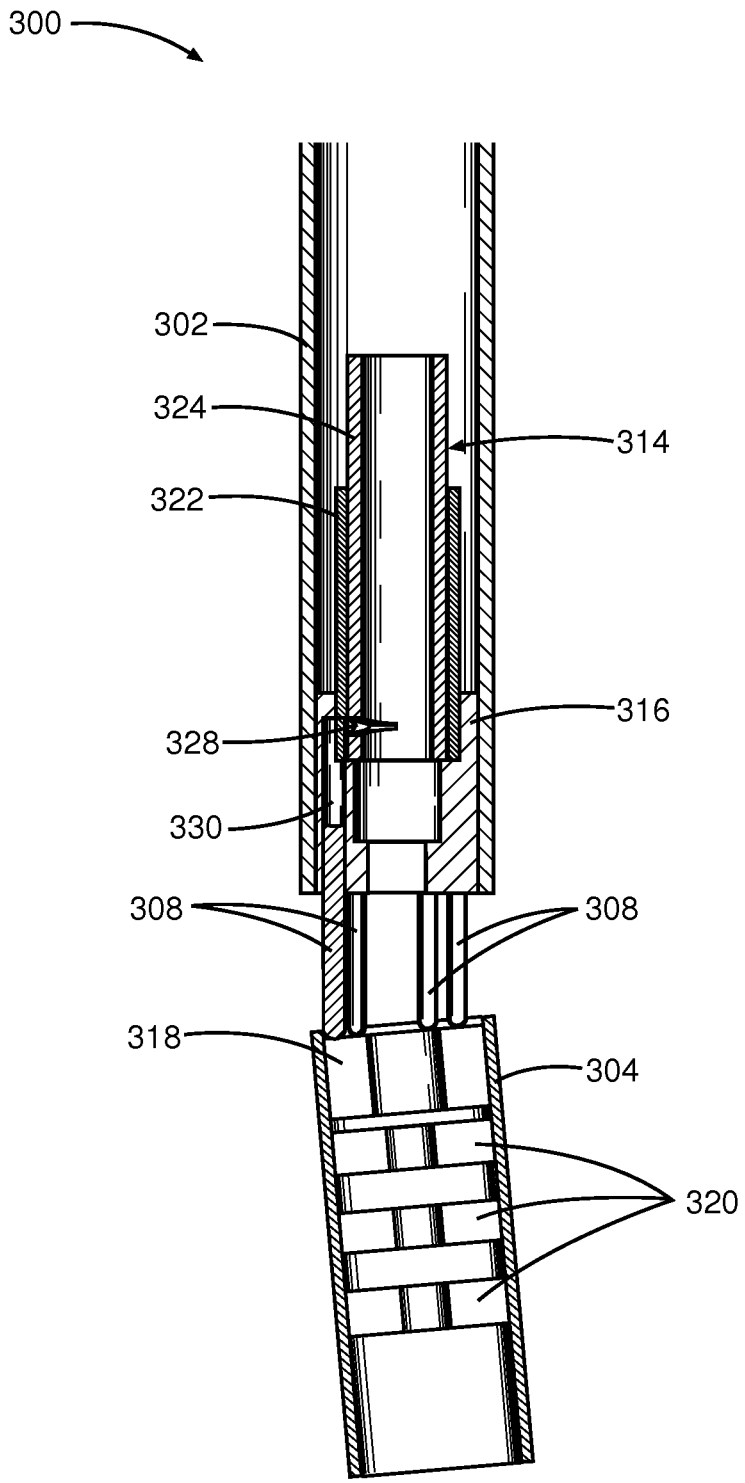

As illustrated in FIG. 3D, as selected pistons 308 move axially toward second sleeve 304, the downhole ends of pistons 308 strike thrust pad 318 and thereby cause second sleeve to tilt at a particular angle relative longitudinal axis 310 of the uphole first sleeve 302. The amount of axial movement of pistons 308 defines the magnitude of the tilt angle of second sleeve 304. The particular one or more of pistons 308 actuated by rotary actuator 314 defines the azimuth of second sleeve 304.

For simplicity, bit shaft 306 is omitted from FIG. 3D. However, as second sleeve 304 is steered away from the vertical path of first sleeve 302, bit shaft 306 between uphole and downhole ends bends smoothly. As illustrated in FIG. 3D, uphole end 313 of bit shaft 306 arranged within third section 332*c* of central bore 332 of cylinder housing remains aligned with longitudinal axis 310, while downhole end 312 is steered to the set tilt angle and azimuth achieved by axial movement of selected pistons 308.

Cylinder housing 316, thrust pad 318, and radial bearings 320 function to support bending of bit shaft 306 when steering mechanism 300 sets the direction of the downhole end of the drill bit connected to shaft 306. Uphole end 313 of bit shaft 306 is fit into third section 332*c* of central bore 332 of cylinder housing 316. Third section 332*c* is configured to hold uphole end 313 of shaft 306 in alignment with longitudinal axis 310 of the uphole first sleeve 302 when the downhole components are deviated from vertical for directional drilling. Central aperture 334 of thrust pad 318 is sized greater than the outer diameter of bit shaft 306 to accommodate the bending of shaft 306 during directional drilling. Additionally, each of radial bearings 320 includes a central aperture which is sized to match the outer diameter of bit shaft 306. Radial bearings 320 thereby function to structurally support the cantilevered downhole end 312 of bit shaft 306 and to cause downhole end 312 to move in conjunction with the steering of second sleeve 304 by the axial movement of selected pistons 308.

As will be understood by those of ordinary skill in the art, movement of third and fourth sleeves 322 and 324 can be controlled and achieved by different types of controls and/or mechanisms. In general, the actuator of a steering mechanism in accordance with this disclosure is configured to be coupled to a controller configured to cause selective axial movement of less than all of pistons 308 to direct second sleeve 304 and downhole end 310 of bit shaft 306 at a selected tilt angle with respect to longitudinal axis 312 of first sleeve 302 and at a selected azimuth. The controller configured to control actuation of pistons 308 can be incorporated into the BHA including steering mechanism 300 or another downhole tool or can be included in a system disposed on the surface of the well in which BHA 300 is deployed.

Figure 3E:
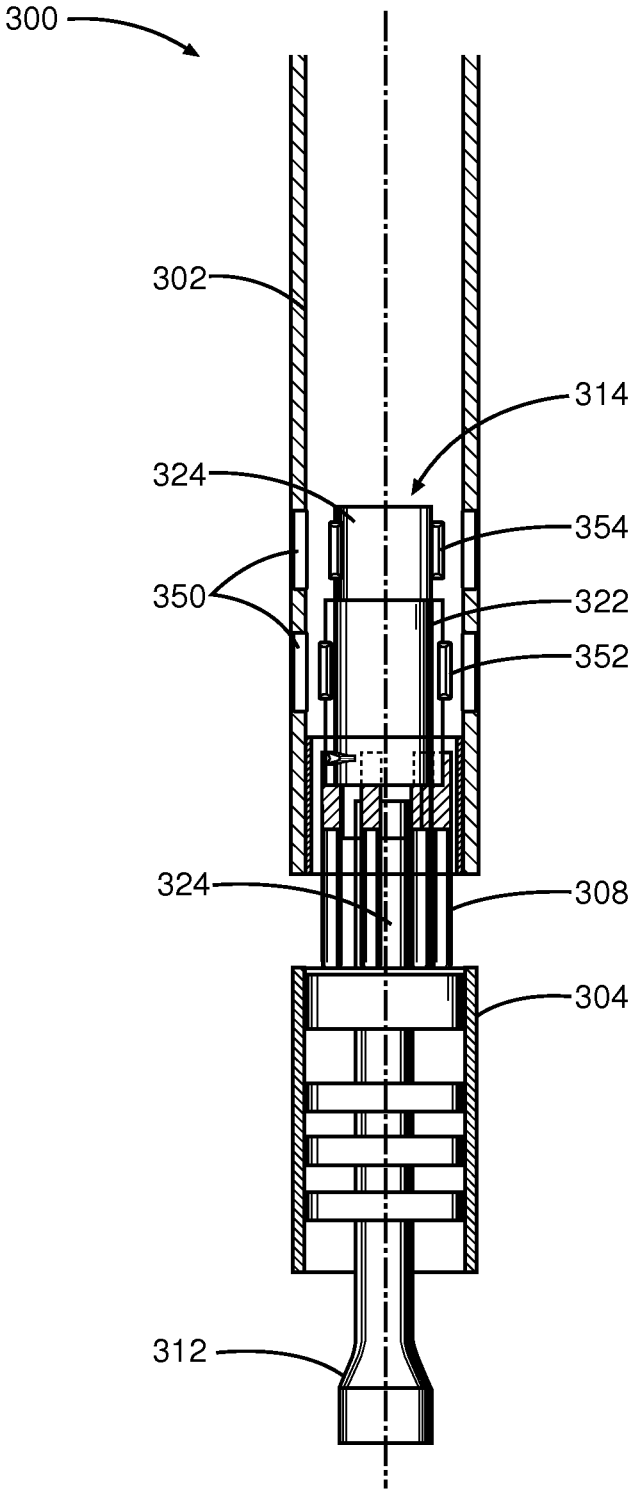

In the case of rotary actuator 314, movement of third and fourth sleeves 322 and 324 can be achieved by a number of different types of mechanical, electromechanical, or other mechanisms. For example, an electromagnetic mechanism can be employed to position third and fourth sleeves 322 to cause selective axial movement of less than all of pistons 308 to direct second sleeve 304 and downhole end 310 of bit shaft 306 at a selected tilt angle with respect to longitudinal axis 312 of first sleeve 302 and at a selected azimuth. One example of such a mechanism is schematically depicted in FIG. 3E. In FIG. 3E, first sleeve 302, in which third and fourth sleeves 322 and 324 are arranged, can include one or multiple electromagnets 350. Third sleeve 322 can include at least one permanent magnet or section of paramagnetic material 352, which is aligned with one of electromagnets 350. Similarly, fourth sleeve 324 can include at least one permanent magnet or section of paramagnetic material 352, which is aligned with another of electromagnet 350. Selective activation of electromagnets 350 can then be employed to rotationally position third and fourth sleeves 322 and 324 relative to one another. The flow of current to electromagnets 350 can be controlled by the controller, as described above.

Additionally, although the foregoing example includes rotary actuator 314, examples according to this disclosure can employ other types of actuators to axially move less than all of a number of pistons to steer a downhole sleeve and downhole end of a bit shaft a particular tilt angle and azimuth. For example, axial movement of the pistons could be actuated using a hydraulic system included in the steering mechanism and/or the BHA of the tool string in which the steering mechanism is included.

Examples according to this disclosure can be employed in a variety of differently configured directional drilling systems. In one example, a steering mechanism in accordance with this disclosure is employed in a completely rotating rotary steering system (RSS). In such an example, a geostationary housing contains the electronics and control system that senses and controls the position of the rotary sleeves of the rotary actuation mechanism. As described above, the relative positions of the inner and outer sleeves of the rotary actuator functions to set the tilt angle and the azimuth of the drill bit.

In another example, a steering mechanism in accordance with this disclosure is employed in a stationary housing RSS. In such an example, a completely stationary housing contains the electronics and control system that senses and controls the position of the rotary sleeves of the rotary actuation mechanism to set the tilt angle and the azimuth of the drill bit.

Another example according to this disclosure includes a simplified version of the foregoing steering mechanism in which only the tilt angle is controlled by the downhole steering mechanism. In such examples, axial movement of one or more pistons are employed to tilt the drill bit at a particular angle. Azimuth, however, is controlled uphole of the drill bit in the vertical section of the tool string and/or at the surface, for example, at the well head. In such examples, the angular position of the axially moving piston(s) about the longitudinal axis of the uphole vertical section(s) of the tool string is used as a reference point and one or more portions of the uphole vertical sections are rotated from this reference point to set the azimuth of the drill bit. Examples according to this disclosure therefore include a controllable, variable tilt angle, bent sub, in which the azimuth is established by movement of the drill string. An example of this type of steering mechanism is illustrated in FIGS. 4A and 4B.

Figure 4A:
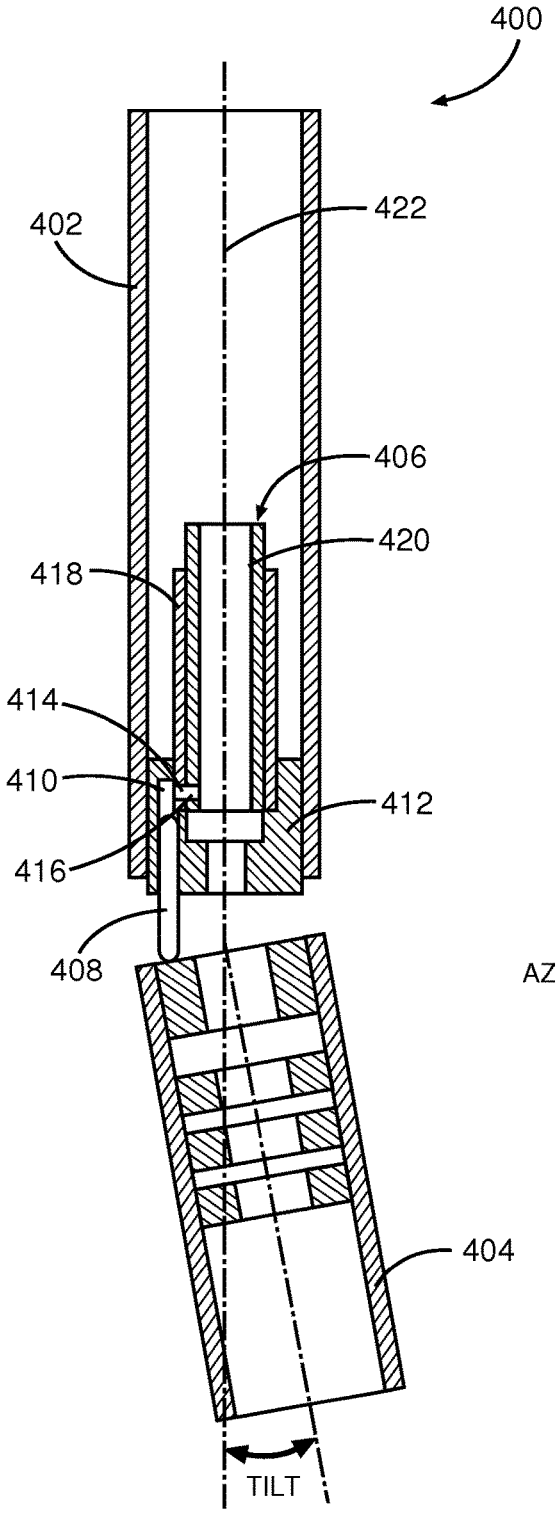
FIG. 4 depicts another example steering mechanism in accordance with this disclosure.
Figure 4B:
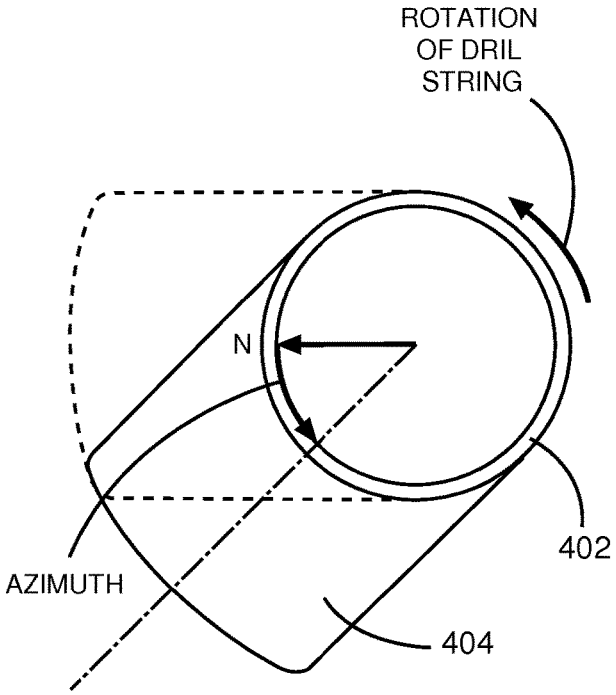

In the example of FIGS. 4A and 4B, steering mechanism 400 includes first and second tubular sleeves 402 and 404, respectively, rotary actuator 406, and a single piston 408. The position of piston 408 and the corresponding position of cylinder 410 in cylinder housing 412 is employed as a reference and can, in some examples, be set to a particular direction like North, as illustrated in FIG. 4B.

To set the tilt angle of second sleeve 404 and the drill bit extending therefrom, circumferential apertures 414 and 416 in third sleeve 418 and fourth sleeve 420, respectively, of rotary actuator 406 are aligned with one another. Aligning circumferential apertures 414 and 416 will allow the fluid to enter cylinder 410 to cause piston 408 to move axially and thereby tilt second sleeve 404 at the desired tilt angle.

To set azimuth, in this example, first sleeve 402 and one or more sections of a tool string uphole from first sleeve 402 are rotated about the vertical longitudinal axis 422 of the string. As illustrated in FIG. 4B, part or all of the tool string including first sleeve 402 is rotated from the reference point, North, by a desired angular deviation to set the azimuth of second sleeve 404 and the associated drill bit. Although the example of FIGS. 4A and 4B show only one piston 408 and associated cylinder 410, multiple circularly arranged pistons could be included in the steering mechanism, for example, as with the example of FIGS. 3A-3E, but only one of these pistons could be employed to set the tilt angle and to function as a reference point for setting the azimuth.

In the foregoing examples, the steering mechanism functions to steer a downhole sleeve relative to uphole portions of a tool string, which, in turn, causes a drill bit shaft to bend between uphole and downhole ends. However, in other examples according to this disclosure the drill bit shaft could be separated into an uphole segment and a downhole segment coupled at a joint such that the shaft need not bend to allow for steering the downhole end. For example, a constant velocity (CV) or universal joint can be employed to couple uphole and downhole segments of the bit shaft. In such examples, the bit shaft may be able to be shorter as no cantilevered bending in the shaft is required. In such a case, the bit-to-bend distance may be decreased, thus making the point-the-bit more effective with a lower reactive moment from the formation. In one example, the universal joint coupling the uphole and downhole segments of the bit shaft can be arranged in the center of the circularly arranged axially moving pistons between the uphole and downhole tubular sleeves of the steering mechanism.

Figure 5:
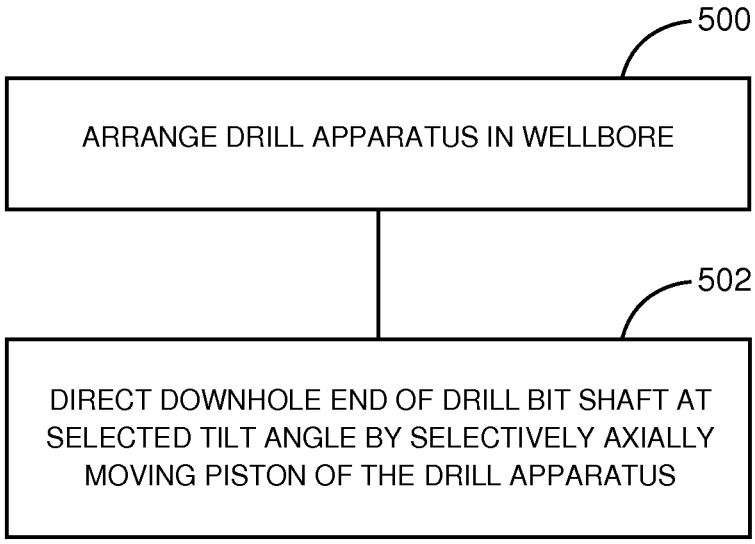
FIG. 5 illustrates an example method of forming a deviated wellbore.

FIG. 5 depicts of an example method of forming a deviated wellbore. The example method of FIG. 5 includes arranging a drill apparatus in a wellbore (500) and directing a downhole end of a drill bit shaft at a selected tilt angle by selectively axially moving at least one piston of the drill apparatus (502). In one example, the drill apparatus arranged in the wellbore includes a first tubular sleeve, a second tubular sleeve, a drill bit shaft, and at least one piston. The bit shaft includes a first end arranged in the first sleeve and a second end arranged in the second sleeve. The piston(s) extends from the first sleeve and engage the second sleeve. The piston(s) is axially moveable relative to the first sleeve and arranged radially outward of the bit shaft.

In order to drill a deviated wellbore, the example method includes directing the second sleeve and the downhole end of the drill bit shaft at a selected tilt angle by selectively axially moving the piston(s) of the drill apparatus. Azimuth can be achieved by axial movement of a plurality of pistons or by rotation of the drill string. For example, the drill apparatus can include a plurality of pistons arranged circularly about the bit shaft and the actuator can be configured to selectively axially move less than all of the pistons to direct the second sleeve and the second end of the bit shaft at a selected tilt angle and at a selected azimuth. In some examples, one or more pistons move axially to set the tilt angle and the first sleeve (and possibly other portions of a drill string connected thereto) is rotated about the longitudinal axis to dispose the bit shaft at a selected azimuth.

Axial movement of the pistons can be achieved and controlled in a variety of ways. In general, the actuator of a steering mechanism in accordance with this disclosure is configured to be coupled to a controller configured to cause selectively axially movement of the piston(s) to direct the drill bit at a selected tilt angle and, in some cases, azimuth. The actuator can include a variety of mechanisms, including, for example, rotary actuators in accordance with examples of this disclosure or other types of actuators such as a hydraulic system that controls hydraulic fluid pressure within the cylinders of the pistons.

Various examples have been described. These and other examples are within the scope of the following claims.

What is claimed is:

1. A drill apparatus for a subterranean well, the apparatus comprising:

a first tubular sleeve;

a second tubular sleeve;

a drill bit shaft positioned in the first sleeve and the second sleeve and comprising a first end arranged in the first sleeve and a second end extending from the second sleeve;

at least one piston extending from the first sleeve and engaging the second sleeve, wherein the at least one piston is axially moveable relative to the first sleeve and arranged radially outward of the bit shaft; and an actuator configured to selectively axially move the at least one piston to direct the second sleeve and the second end of the bit shaft at a selected tilt angle with respect to a longitudinal axis of the first sleeve.

2. The drill apparatus of claim 1, wherein the at least one piston comprises a plurality of pistons arranged circularly about the bit shaft and the actuator is configured to selectively axially move less than all of the pistons to direct the second sleeve and the second end of the bit shaft at the selected tilt angle with respect to the longitudinal axis of the first sleeve and at a selected azimuth.

3. The drill apparatus of claim 2, wherein:

the first sleeve comprises a first end adjacent a first end of the second sleeve;

the first end of the second sleeve comprises a thrust pad comprising a first central aperture through which the bit shaft is disposed; and the pistons extend from the first end of the first sleeve and engage the thrust pad.

4. The drill apparatus of claim 3, further comprising a cylinder housing arranged within the first end of the first sleeve, the cylinder housing comprising a plurality of cylinders in which the pistons are respectively arranged and a second central aperture through which the first end of the bit shaft is disposed.

5. The drill apparatus of claim 4, further comprising at least one radial bearing arranged within the second sleeve and comprising a third central aperture through which the second end of the bit shaft is disposed.

6. The drill apparatus of claim 5, wherein:

the first central aperture is greater than an outer diameter of the bit shaft; and the second and third central apertures are sized to match the outer diameter of the bit shaft; and when the second sleeve is directed at the selected tilt angle and azimuth, a portion of the bit shaft between the cylinder housing and the at least one radial bearing bends.

7. The drill apparatus of claim 4, wherein the actuator comprises:

a third tubular sleeve comprising a first circumferential aperture, wherein the third sleeve is at least partially arranged within and rotationally moveable relative to the cylinder housing; and a fourth tubular sleeve comprising a second circumferential aperture, wherein the fourth sleeve is at least partially arranged within and rotationally moveable relative to the third sleeve, and wherein the third and the fourth sleeves are configured to rotate to align the first and second circumferential apertures with one another and with one or more of the cylinders of the cylinder housing.

8. The drill apparatus of claim 7, wherein the actuator comprises a hydraulic actuator configured to selectively axially move one or more of the pistons via a hydraulic fluid in the cylinders of the cylinder housing.

9. The drill apparatus of claim 1, wherein the bit shaft is configured to rotate relative to the first and second sleeves.

10. The drill apparatus of claim 1, wherein the first and second sleeves and the bit shaft are configured to rotate together.

11. The drill apparatus of claim 1, further comprising a drill bit coupled to the second end of the bit shaft.

12. The drill apparatus of claim 1, further comprising a motor operatively coupled to and configured to rotate the bit shaft.

13. The drill apparatus of claim 12, wherein the motor comprises a positive displacement motor configured to be arranged downhole within a well bore of the well.

14. The drill apparatus of claim 1, further comprising a controller configured to control the actuator to cause the at least one piston to selectively axially move.

15. The drill apparatus of claim 1, wherein the first sleeve is configured to be rotated about the longitudinal axis to dispose the bit shaft at a selected azimuth.

16. A system comprising:

a drill string configured to be disposed in a wellbore and coupled at the surface to a drilling rig; and a bottom hole assembly coupled to the drill string and comprising:

a first tubular sleeve;

a second tubular sleeve;

a drill bit shaft positioned in the first sleeve and the second sleeve and comprising a first end arranged in the first sleeve and a second end extending from the second sleeve; and at least one piston extending from the first sleeve and engaging the second sleeve, wherein the at least one piston is axially moveable relative to the first sleeve and arranged radially outward of the bit shaft;

an actuator configured to selectively axially move the at least one piston to direct the second sleeve and the second end of the bit shaft at a selected tilt angle with respect to a longitudinal axis of the first sleeve.

17. The system of claim 16, wherein the at least one piston comprises a plurality of pistons arranged circularly about the bit shaft and the actuator is configured to selectively axially move less than all of the pistons to direct the second sleeve and the second end of the bit shaft at the selected tilt angle with respect to the longitudinal axis of the first sleeve and at a selected azimuth.

18. The system of claim 17, wherein:

the first sleeve comprises a first end adjacent a first end of the second sleeve;

the first end of the second sleeve comprises a thrust pad comprising a first central aperture through which the bit shaft is disposed; and the pistons extend from the first end of the first sleeve and engage the thrust pad.

19. The system of claim 18, further comprising a cylinder housing arranged within the first end of the first sleeve, the cylinder housing comprising a plurality of cylinders in which the pistons are respectively arranged and a second central aperture through which the first end of the bit shaft is disposed.

20. The system of claim 19, further comprising at least one radial bearing arranged within the second sleeve and comprising a third central aperture through which the second end of the bit shaft is disposed.

21. The system of claim 20, wherein:

the first central aperture is greater than an outer diameter of the bit shaft; and the second and third central apertures are sized to match the outer diameter of the bit shaft; and when the second sleeve is directed at the selected tilt angle and azimuth, a portion of the bit shaft between the cylinder housing and the at least one radial bearing bends.

22. The system of claim 19, wherein the actuator comprises:

a third tubular sleeve comprising a first circumferential aperture, wherein the third sleeve is at least partially arranged within and rotationally moveable relative to the cylinder housing; and a fourth tubular sleeve comprising a second circumferential aperture, wherein the fourth sleeve is at least partially arranged within and rotationally moveable relative to the third sleeve, and wherein the third and the fourth sleeves are configured to rotate to align the first and second circumferential apertures with one another and with one or more of the cylinders of the cylinder housing.

23. The system of claim 22, wherein the actuator comprises a hydraulic actuator configured to selectively axially move one or more of the pistons via a hydraulic fluid in the cylinders of the cylinder housing.

24. The system of claim 16, wherein the bit shaft is configured to rotate relative to the first and second sleeves.

25. The system of claim 16, wherein the first and second sleeves and the bit shaft are configured to rotate together.

26. The system of claim 16, further comprising a drill bit coupled to the second end of the bit shaft.

27. The system of claim 16, further comprising a motor operatively coupled to and configured to rotate the bit shaft.

28. The system of claim 27, wherein the motor comprises a positive displacement motor configured to be arranged downhole within a well bore of the well.

29. The system of claim 16, further comprising a controller configured to control the actuator to cause the at least one piston to selectively axially move.

30. The system of claim 16, wherein the first sleeve is configured to be rotated about the longitudinal axis to dispose the bit shaft at a selected azimuth.

31. A method comprising:

arranging a drill apparatus in a well bore of a subterranean well, wherein the drill apparatus comprises:

a first tubular sleeve;

a second tubular sleeve;

a bit shaft positioned in the first sleeve and the second sleeve and comprising a first end arranged in the first sleeve and a second end extending from the second sleeve; and at least one piston extending from the first sleeve and engaging the second sleeve, wherein the at least one piston is axially moveable relative to the first sleeve and arranged radially outward of the bit shaft;

directing the second sleeve and the second end of the bit shaft at a selected tilt angle with respect to a longitudinal axis of the first sleeve by selectively axially moving the at least one piston.

32. The method of claim 31, wherein the at least one piston comprises a plurality of pistons arranged circularly about the bit shaft, and wherein directing comprises directing the second sleeve and the second end of the bit shaft at the selected tilt angle with respect to the longitudinal axis of the first sleeve and at a selected azimuth by selectively axially moving less than all of the pistons.

* * * * *